United States Patent [19]

Serizawa et al.

[11] 4,022,046

[45] May 10, 1977

[54] METHOD OF AND APPARATUS FOR STRAIGHTENING STEEL SECTIONS

[75] Inventors: Shizuo Serizawa; Seiichi Sasahira, both of Kitakyushu, Japan

[73] Assignee: Nippon Steel Corporation, Tokyo, Japan

[22] Filed: Jan. 21, 1976

[21] Appl. No.: 650,907

Related U.S. Application Data

[63] Continuation of Ser. No. 527,304, Nov. 26, 1974, abandoned.

[30] Foreign Application Priority Data

Dec. 3, 1973 Japan ..... 48-136395

[52] U.S. Cl. ..... 72/161; 72/164

[51] Int. Cl.[2] ..... B21D 3/02

[58] Field of Search ..... 72/160–165, 72/247

[56] References Cited

UNITED STATES PATENTS

| | | | |
|---|---|---|---|
| 182,302 | 9/1876 | Chisholm et al. | 72/164 |
| 2,279,038 | 4/1942 | Gifford | 72/164 |
| 3,756,056 | 9/1973 | Dobrott | 72/164 |

*Primary Examiner*—Milton S. Mehr

*Attorney, Agent, or Firm*—Toren, McGeady and Stanger

[57] ABSTRACT

In straightening steel sections, a machine is used having straightening rollers and pressing rollers each formed with a contact surface and arranged oppositely on vertical line of the straightening rollers. The cross-section of the steel section to be straightened is held between the contact surfaces of the rollers, and the pressing rollers are displaceable in the reduction direction as well as in the axial direction to adjust the amount of displacement.

4 Claims, 16 Drawing Figures

METHOD OF AND APPARATUS FOR STRAIGHTENING STEEL SECTIONS

This is a continuation of application Ser. No. 527,304 filed on Nov. 26, 1974, now abandoned.

BACKGROUND OF THE INVENTION

Contrary to ordinary steel plates, a steel section has a complicated cross-sectional shape, and its shape after hot rolling and cooling shows peculiar bends.

A steel section is used mainly for construction and shipbuilding materials, and its straightness and good shape are important requirements for such uses, and in addition, with the advance of automation techniques (numerical control, etc.) of processing machines in recent years, the straightness and the precision of the shape of steel sections have been further required. Accordingly, straightening after hot rolling and cooling is required so as to give an extremely high degree of straightness to such finished steel products.

In a conventionally known straightening machine for steel sections, as shown in FIG. 1 and FIG. 2, straightening rollers 2, 2' are arranged zigzag or offset in the vertical direction and guide rollers A and B having vertical axes for controlling right and left movements of the material 1 at inlet and outlet sides of the group of straightening rollers 2, 2'.

In such a conventional roller straightening machine, surfaces which will suitably contact the cross-sectional shape of material are formed on upper and lower straightening rollers 2, 2', which are arranged so as to be displaced in the vertical direction as well as in the axial direction.

However, in such a conventional roller straightening machine as mentioned above, positive and negative bends may be sufficiently given in the vertical direction or the like, so that straightening effect in that direction may be obtained, but straightening effect in the horizontal direction perpendicular to the direction of advance of the material 1 is not sufficient in view of its mechanism. This is attributable to the fact that as shown in FIG. 4, for instance, in a steel section, such as an angle with unequal legs (hereinafter, simply called an "invert"), having a section with large rigidity in right and left directions and large bends in right and left directions (seen from the direction in FIG. 4), if the straightening rollers 2, 2' are displaced and adjusted in the axial direction so as to effect bending, the material 1 will be off from the pass-line of the group of straightening rollers by repulsive force due to rigidity of the material and will shift and pass in the axial direction of straightening rollers, as shown in the drawing, resulting in an insufficient, straightening force in the right and left directions.

To correct this defect, straightening of a steel section in a cross-sectional posture is effected as a example shown in FIG. 5(*b*), wherein the material 1 (FIG. 5(*a* ) ) is apt to undergo abnormal deformation due to buckling as shown in FIG. 5(*c*), furthermore threading of the material 1 through the group of straightening rollers in such a cross-sectional posture (in this case, FIG. 5(*a*) ) is difficult, so that the working property is considerably hindered.

SUMMARY OF THE INVENTION

This invention relates to a roller straightening machine for a steel section, having its object to solve problems confronted by the conventional roller straightening machine for steel sections and to obtain a steel section which is excellent in its straightness and shape, as well as to provide a roller straightening machine for steel section having an excellent working property. The features of the present invention reside in;

1. a method for strightening a steel section which comprises reducing at least an inner side portion of a section steel curved in a horizontal plane to the lengthwise direction of the steel shape, and 2. a roller straightening machine for a steel section which comprises a pressing roller provided on the vertical line of a straightening roller having a contact surface, said pressing roller having a contact surface which forms the cross section of the shape steel in cooperation wth the contact surface on the straightening roller and being displaceable in the vertical direction as well as in the axial direction.

BRIEF DESCRIPTION OF THE DRAWINGS

FIG. 5(*c*) is a sketch showing an abnormal deformation when the invert is straightened;

FIG. 10 is a cross sectional view of a portion of the straightening machine;

DESCRIPTION OF THE PREFERRED EMBODIMENTS:

In the following, the present invention will be explained with reference to the accompanying drawings, particularly, FIG. 6 to FIG. 9.

Figure 7:
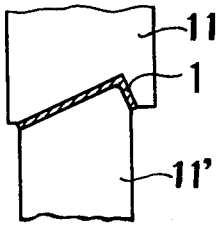
FIG. 7 is a sketch showing a state, wherein the steel section is normally held between the straightening roller and the pressing roller.
Figure 6:
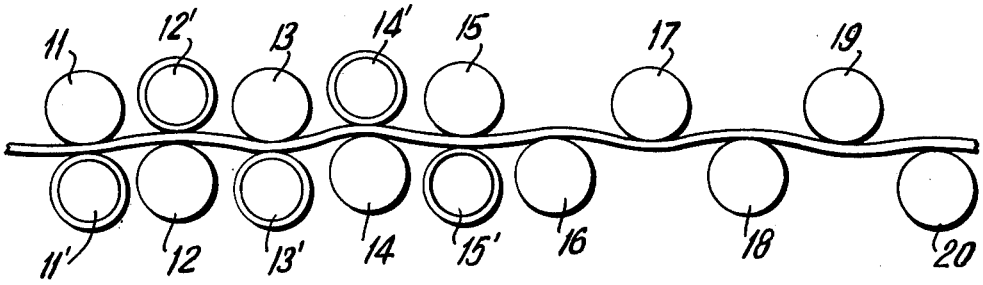
FIG. 6 is an elevational view, showing the arrangement of a straightening machine according to the invention.
Figure 8A:
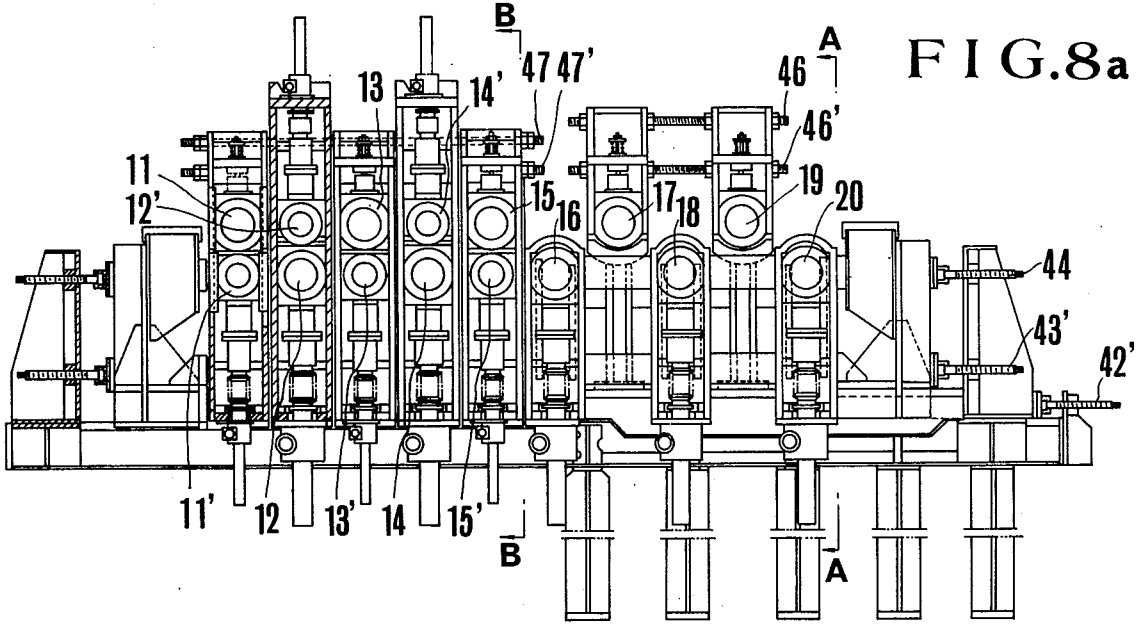
FIGS. 8*a*, 8*b*, 8*c*, and 9 show respectively one embodiment of the roller straightening machine of the present invention.
Figure 8B:
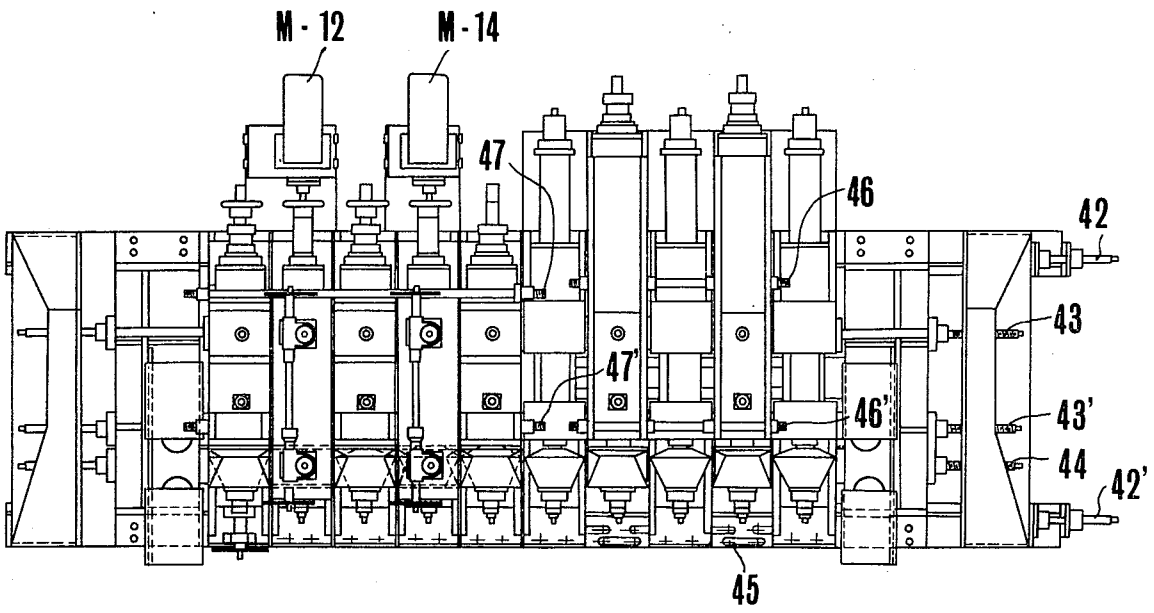
Figure 8C:
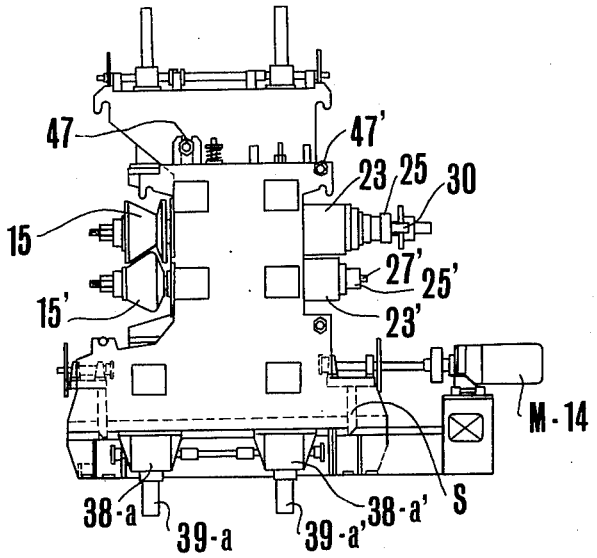
Figure 8D:
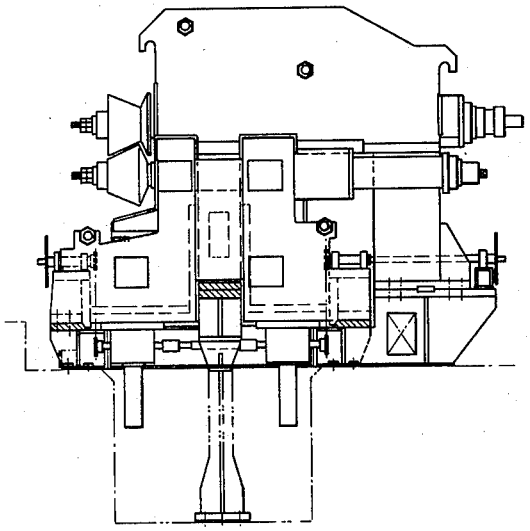
Figure 9:
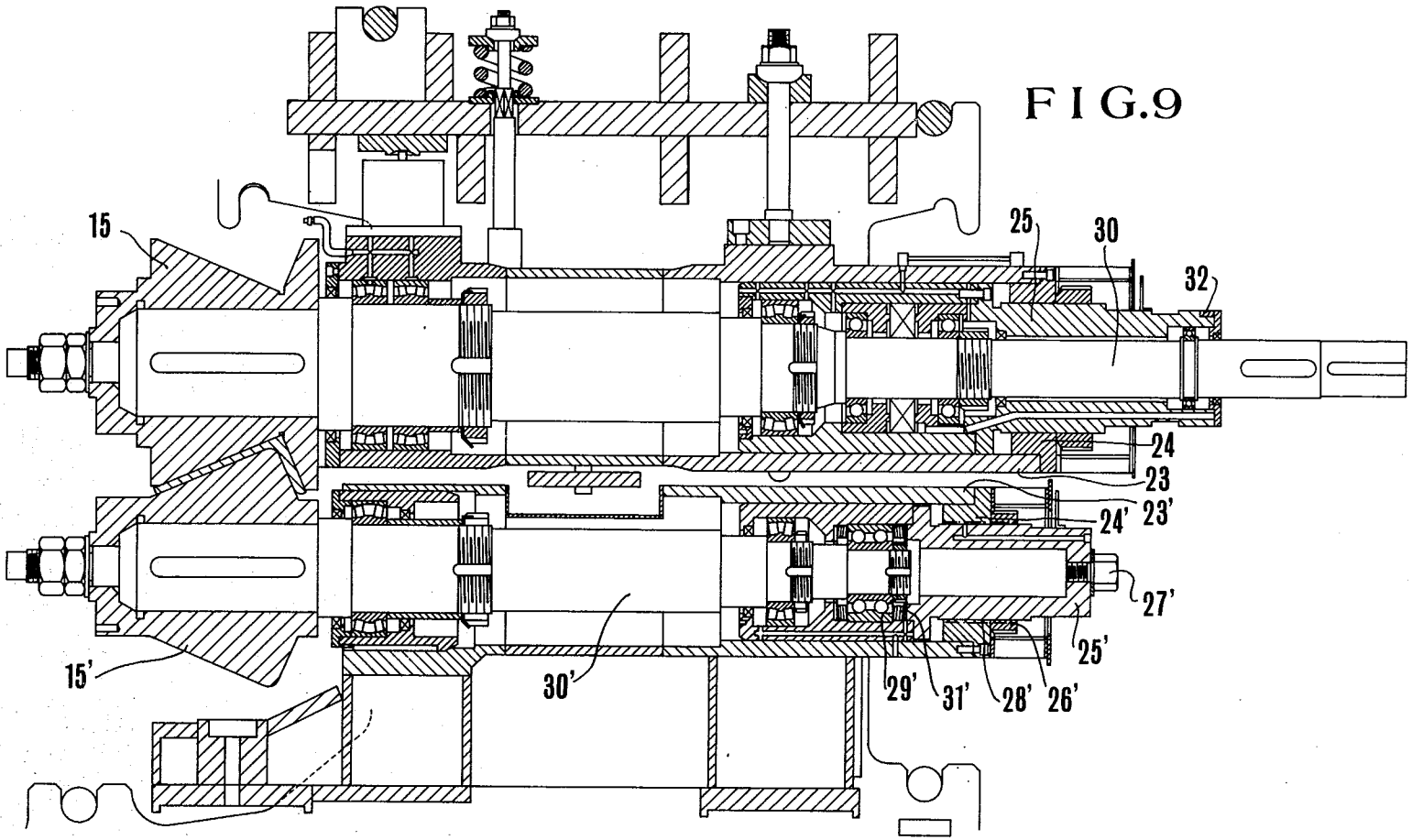

In FIG. 6, 1 is a steel section, 11, 12, 13, 14, 15, 16, 17, 18, 19 and 20 are straightening rollers and ,11', 12', 13', 14' and 15' are press rollers. Both the straightening rollers and the press rollers are respectively arranged zigzag in suitable number seen from the side of the pass of the steel section 1. Steel sections usually have a web with one or more flanges extending transversely of the web or a pair of legs, as in an angle, disposed perpendicularly to one another. Examples of steel sections are angles, T-bars, channels, I-beams and the like. As shown in FIG. 7, the straightening upper roller 11 and the press lower roller 11' are formed with contact surfaces which are shaped substantially conforming to the cross- sectional shape of the material. The straightening rollers are constructed so as to have such strength that the steel section may be lightly rolled in combination with the pressing rollers. The other upper rollers 12′, 13, 14′, 15, 17 and 19 are formed with contact surfaces of the same shape as the roller 11 and the other lower rollers 12, 13′, 14, 15′, 16 and 20 are also engraved with calibers of same shape as the roller 11′. The rollers 11, 11′, 12, 12′, 13, 13′, 14, 14′, 15 and 15′constitute the straightening and rolling section where both straightening and light rolling are effected, while the rollers 16, 17, 18, 19 and 20 constitute the straightening section where only straightening is effected. The lower rollers may be displaced in the direction of reduction and the amount of reduction may be adjusted. The displacement in the direction of reduction of the lower rollers is effected and controlled by a conventional reduction screw mechanism or hydraulic cylinder or the like. The lower rollers may be also displaced in the axial direction and their amount of displacement is also adjustable. These are effected by means of a conventional screw mechanism and the like.

The upper rollers 12′ and 14′ are pressing rollers, having the same mechanism as the lower rollers and capable of displacing in the direction of the reduction by means of a conventional reduction screw mechanism, hydraulic cylinder or the like and also capable of adjusting the amount of the displacement. These pressing rollers 12″ and 14″ are formed with contact surfaces which are shaped substantially conforming to the cross-sectional shape of the material, in combination with the contact surfaces on the lower rollers 12 and 14.

Further, the pressing rollers 12′ and 14′ contrary to the other upper rollers, have such a mechanism that they are displacable in the axial direction and the amount of the displacement is adjustable, by means of a conventional screw mechanism or the like. The number of the straightening rollers and the pressing rollers may be increased or decreased if necessary.

In the next place, the functions of the straightening machine according to this invention will be described, as follows.

As shown in FIG. 6, relative position in the direction of reduction of the straightening rollers is set up by the amount to be straightened, shape, size and the like of the steel section 1, under the state of zigzag arrangement.

In this embodiment, the above setting up is effected by displacing the lower roller 11′, but not always be limited thereto.

Next, as shown in FIG. 7, between the upper and lower rollers in the straightening an rolling section, there is provided a clearance corresponding to the thickness of section of the material 1.

In this case, the relative positions in the axial direction of both of the straightening rollers and the pressing rollers are simultaneously set up corresponding to the amount to be straightened in the right and left directions, size and shape seen from the pass direction of the steel section 1.

By adjusting the relative positions of the upper or lower rollers in the lengthwise direction of the machine, the flange portion of clearance between the upper and lower rollers can be increased or decreased so that it is possible to lightly reduce only the flange portion of the shape steel material.

Figure 1:
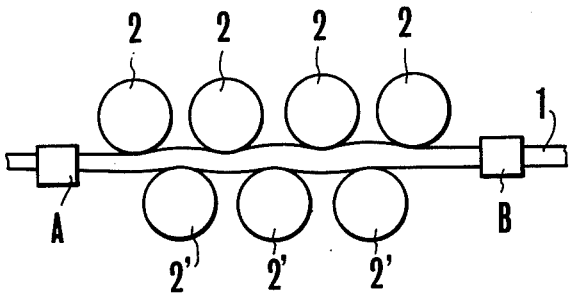
FIG.1 PRIOR ART
FIG. 1 is an elevational view of a prior art roller straightening machine.
Figure 2:
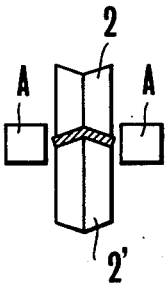
FIG.2 PRIOR ART
FIG. 2 is a side view of the machine of FIG. 1.
Figure 3:
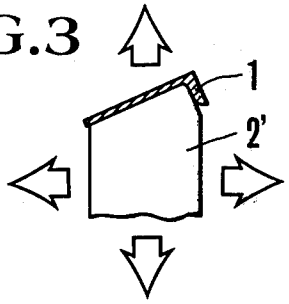
FIG. 3 is a sketch showing a straightening roller in suitable contact with a steel section.
Figure 4:
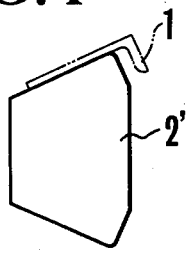
FIG. 4 is a sketch showing a steel section deviated from the straightening roller, FIG. 5 (*a*) is an invert to be straightened.
Figure 5A:
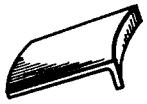
FIG. 5(*b*) is a threading posture in case the relief of material in right and left directions is prevented.
Figure 5B:
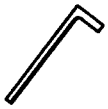
Figure 5C:
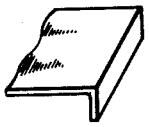

In this case, as shown in FIG. 7, the flange portion (short side) of the material as shown in FIG. 5(*a*) is lightly rolled and its thickness is reduced, but remains within the tolerance of size, thus the material 1 is straightened without abnormal deformation (wrinkle) in the web portion (long side) as shown in FIG. 5(*c*).

A specific embodiment of the roller straightening machine according to the present invention will be described referring to FIGS. 8*a*, 8*b*, 8*c*, 8*d* and 9.

In FIGS. 8*a*, 8*b*, 8*c*, 8*d*, and 9, rollers 11, 12, 13, 14, 15, 16, 17, 18, 19 and 20 are straightening rollers and are all movable in their axial direction. The upper rollers 11, 13, 15, do not move in the vertical direction while the upper rollers 12′, 14′, 17 and 19 can move in the vertical direction. Rollers 11′, 12′, 13′, 14′, and 15′ are pressing rollers and all can move in the vertical direction and also in the axial direction. The movement of the rollers in the vertical and axial directions are normally effected by a screw mechanism.

The movement of the pressing rollers in the vertical and axial directions are normally effected by a screw mechanism, but to give elasticity to the rollers, springs are provided at the upper end of the reduction screw and at the rear end of the roller axis. Thereby, almost constant pressing load or light reduction load canbe maintained even when the thickness of the work piece varies.

Positioning of the straightening rollers can be done in a conventional way by rotating the screw so as to maintain each lower roller at a predetermined proper height, and by rotating the screw for adjustment in the axial direction of the rollers.

While the main rollers are being positioned all of the pressing rollers are left free.

The positioning of the pressing rollers is done by inserting the work piece for setting the roll space between the rotating rollers after the completion of positioning of the main rollers and stopping the rollers, and then moving each pressing roller in the vertical and axial direction so as to contact the work piece slightly. The adjustment of the pressing roller is done by checking the space between the roller and the work piece by means of a thickness guage, etc. When the pressing roller is pushed until the space disappears, the pressing roller is further pushed until a load cell incorporated in the reduction screw portion give a certain constant load, or the pressing roller is pushed by a certain amount of fine rotation of the reduction screw so as to press the work piece against the main roller.

Then the rollers are rotated to feed out the space-setting work piece for subsequent straightening operation.

Detailed descriptions will be made regarding to movement of the roller in the vertical and axial directions referring to the roller 13′.

First, the nut 26′ is manually released and the bolt 27′ is rotated manually to rotate the hollow shaft 25′ which is moved in the axial direction by engagement between the threads on the outer surface of the shaft 25′and the threads on the inner surface of the nut 24 fixed on the housing 23′. Along with the movement of the hollow shaft 25′ in the axial direction, the shaft 30′ contained in the hollow portion of the hollow shaft is pushed thereby by means of the spring 31′, but the rotation of the hollow shaft is not transferred to the shaft 30′ because of the ball bearing 29′. Therefore, the roller 15′ which is fixed to the shaft 30′ is moved in the axial direction.

The movement of the upper roller 15 in the axial direction is effected in the same way as the roller 15′ except that the shaft 25 is rotated using a wrench.

The rollers 11′, 12′, 13′, 14′ and 15′ can be moved both in the vertical direction and in the axial direction.

Detailed description will be made referring to the roller 15' for their vertical movement.

Figures 10A, 10B:
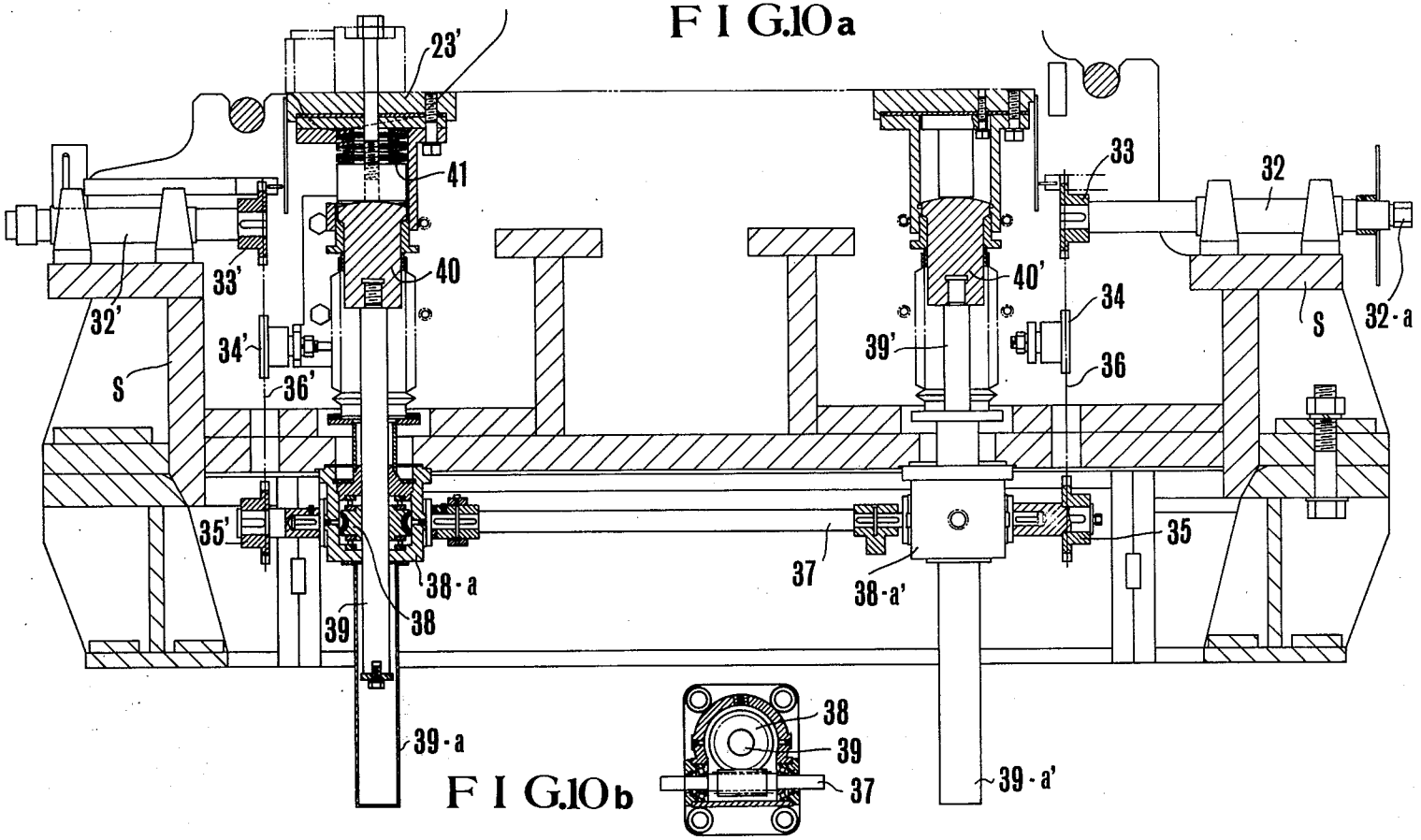
FIG. 10*b* is a cross sectional view taken aong line A—A in FIG. 10*a*.

The shaft 32 supported by the supporting member S is rotated by means of the bolt **32-*a* to rotate the sprocket 33 and then the srockets 34 and 35 by means of the chain 36. The rotation of the sprocket 35 is transferred to the shaft 37 to rotate the worm gear 38 (see FIG. 10-*b*) contained in the gear box 38-*a*. By the engagement of the threads on the outer surfaces of the two shafts 39 and 39' with the worm gear, the shaft 39 is moved in the vertical direction and the housing 23' is moved thereby up and down by means of the member 40 fixed at the upper end of the shaft 39 and the spring 40. In this way, the roller 15' fixed to the housing 23'** is moved up and down.

The shaft 32' can be rotated also by means of the bolt **32-*a'* in the same way as above. In this case the sprockets 33', 34' and 35' are rotated by means of the chain 36' to rotate the worm gear 38 to move the shaft 39** in the vertical direction.

Meanwhile, adjustment of pitches between the rollers are made by moving the housings by means of the bolt mechanism provided in the elongated opening 45 and the bolt mechanisms 42, 42', 46, 46', 47 and 47' note FIG. **8*b***.

Since this invention has such a construction and functions as mentioned above, not only a steel section having symmetrical cross-section, but also a steel section having unsymmetrical cross-section such as invert, can be given excellent straightness and accurate cross-section as well as can take remarkable effect in the field of power saving such as excellent working property in straightening operation and the like.

What is clamed is:

1. A method of straightening a steel section which is formed monolithically of a main web portion and a flange or leg extending transversely of the web portion, comprising passing the steel section between a plurality of spaced pairs of roller contacting surfaces with the opposite sides of the main web portion and the flange each contacting one of the contacting surfaces, adjustably positioning in the axial direction thereof and in the direction relative to the other contacting surface in the pair one of the contacting surfaces of each pair of contacting surfaces for reducing at least the flange thickness of the steel section passing between the contacting surfaces, alternating the pairs of roller contacting surfaces so that in adjacent pairs of roller contacting surfaces the location of the adjustably postionable one of the contacting surfaces contacts opposite sides of the steel section, in each pair of contacting surfaces straightening the steel section with one roller contacting surface and pressing the steel section with the other contacting surface.

2. A roller straightening machine for steel sections each monolithically formed of a main web portion and a flange or leg extending transversely of the web portion, comprising a pluralilty of straightening rollers and pressing rollers with the axes of the rollers disposed horizontally to receive and pass a horizontally extending steel section therebetween, said rollers arranged in pairs with each pair consisting of one straightening roller and one pressing roller disposed in vertically spaced and aligned relation so that the horizontally extending steel section passes between and in contact with the straightening roller and pressing roller of each said pair, in each said pair said straightening roller being displaceable in the axial direction thereof and having an angularly shaped contact surface which contacts the main web portion and flange of the steel section, and said pressing roller being displaceable in the axial direction and and in the vertical direction and having an angularly shaped contact surface which contacts the main web portion and flange of the steel section, means associated with said pressing pair of rollers for mounting said pressing roller and displacing said pressing roller in the vertical and axial directions for positioning the contact surfaces of the pressing roller relative to the contact surfaces of the straightening roller for effecting a reducing action on at least the flange thickness of the steel section passed between the rollers of each said pair, in adjacent said pairs of rollers positioning one straightening element above the steel section and the other below the steel section.

3. A roller straightening machine as set forth in claim 2, wherein the spacing between the contacting surfaces in each said pair of a straightening roller and a pressing roller forms a bite for receiving the steel section and the bites in adjacent pairs of said rollers are offset in the vertical direction relative to one another.

4. A roller straightening machine, as set forth in claim 2, wherein said pressing rollers are hollow, and said means mounting said pressing rollers comprises a shaft for supporting said hollow pressing roller, said shaft being displaceable in the axial direction of said pressing roller, and supporting means mounting said shaft for said pressing roller and arranged for moving said shaft and said pressing roller in the vertical direction.

* * * * *